United States Patent [19]

Prevel

[11] Patent Number: 4,492,585

[45] Date of Patent: Jan. 8, 1985

[54] PROCESS FOR THE ANTIFELTING TREATMENT OF KERATINOUS FIBRES, COMPRISING A BASIC OXIDATION CATALYZED BY A METAL SALT, AND FIBRES SO OBTAINED

[75] Inventor: Pierre Prevel, Caudebec-les-Elbeuf, France

[73] Assignee: Societe Normande de Recherches et de Participation, Louviers, France

[21] Appl. No.: 511,113

[22] Filed: Jul. 5, 1983

[30] Foreign Application Priority Data

Jul. 7, 1982 [FR] France ..... 82 11950

[51] Int. Cl.[3] ..... D06P 5/22; D06L 3/02; D06L 3/04; D06M 3/22

[52] U.S. Cl. ..... 8/493; 8/111; 8/128 R

[58] Field of Search ..... 8/128 R, 111, 493

[56] References Cited

U.S. PATENT DOCUMENTS

| | | | |
|---|---|---|---|
| 2,599,977 | 6/1952 | Cunliffe et al. | 8/128 |
| 2,914,374 | 11/1959 | Harris | 8/111 |
| 3,156,654 | 11/1964 | Konecny et al. | 8/111 |
| 3,632,295 | 1/1972 | Hall et al. | 8/111 |

FOREIGN PATENT DOCUMENTS 1435360 7/1966 France .

*Primary Examiner*—Maria Parrish Tungol

*Attorney, Agent, or Firm*—Beveridge, DeGrandi & Kline

[57] ABSTRACT

Antifelting treatment of keratinous fibres according to which the material is freed of its natural or foreign impurities by an aqueous detergent bath containing at least one metal ion sequestering agent; the rinsed material is treated by a water-soluble salt of a metal having several valencies, hot, in an aqueous bath of pH 3 to 4 during a sufficient period of time to achieve the homogeneous fixing of the metal salt on the fibre; the rinsed material is treated with an aqueous bath in the presence of an oxidizing agent which does not introduce metal ions and of an organic base at a pH of 8.5 to 9, hot, for 1 hour 30 minutes to 2 hours; the rinsed material is treated with an aqueous bath containing a reducing agent which does not introduce metal ions and a sequestering agent, to eliminate the ingredients used; and the material obtained is treated by an aqueous bath at pH 3, the material being subsequently drained and dried over acid.

A keratinous material is thus obtained for which felting is considerably reduced and the feel qualities of which remain practically unchanged.

12 Claims, No Drawings

PROCESS FOR THE ANTIFELTING TREATMENT OF KERATINOUS FIBRES, COMPRISING A BASIC OXIDATION CATALYZED BY A METAL SALT, AND FIBRES SO OBTAINED

This invention relates to a process for the antifelting treatment of undyed keratinous fibres, of any origin, at any material processing stage, with the above-mentioned process comprising a basic oxidation catalyzed by a metal salt.

During the various weaving operations and because of aging due mainly to washing and wear it is observed that more or less marked felting occurs, for fabrics which have undergone no treatment to prevent it, so considerably reducing the qualities and value of these fabrics, notably in the making of garments.

Many processes are known which are aimed at eliminating the felting of fibres and fabrics in general insofar as is possible.

Certain processes are based on the chlorination of keratinous fibres by means of chorinated organic compounds and in the presence of a metal salt, more particularly of alkali metals, but fibres thus treated feel rougher and less pleasant.

Other processes use compositions consisting of the combination of cationic compounds, notably quaternary ammonium compounds and surface active agents.

Other processes also use compositions comprising prepolymers subsequently polymerized on the fibres, or again the fixing of cation type resins onto the fibre.

The above-mentioned processes have the drawback of either being too specific to the type of fibres treated or of altering the feel so that it is too far from the fibre's natural feel and, more often than not, of being very expensive owing to the ingredients used or to the duration and complexity of the treatment.

An object of the invention is an antifelting method which respects the structure of the treated keratinous fibre as much as possible and broadly preserves its initial feel qualities, which is much sought after by the users.

Another object of the invention is the application of a simple, speedy antifelting process which is very generally applicable to the various types of keratinous fibres.

Finally an object of the invention is the treated keratinous material possessing outstanding antifelting properties whilst retaining feel qualities very close to those of the natural keratinous material.

The process of the invention consists essentially in treating a keratinous fibre in an aqueous medium with a very low quantity of a sufficiently soluble salt of a multivalent metal in the presence of a weak organic acid, hot, so as to fix on the fibre a thin unbroken layer of the metal salt, in treating the fibre thus coated by heating in an oxidizing aqueous bath in the presence of an organic base, the fibre then being washed in an appropriate manner and passed through an acid bath before being drained and dried.

Although the mechanism producing the required antifelting result has not yet been clearly determined it seems that the metal salt distributed in a thin layer round the keratin fibre has a catalytic action by which, in a basic oxidizing medium, a surface alteration of the fibre is produced, with opening up of the keratin's sulphur linkages and partial rearrangement of the structure comprising sulphur and nitrogen linkages.

To give greater detail, the treatment is carried out according to the following stages:

The material, previously pressed dry, is wetted cold with purified water containing a detergent agent and, after the addition of a metal ion sequestering agent, and of an alkaline phosphate if the material is very dirty, washing is performed at a temperature of 40° to 50° C. with circulation of the bath for a long enough time to provide a material that is free of its natural or foreign impurities, following which the bath is emptied and the material is washed with purified water.

The material thus obtained is treated with a bath of purified water containing, for 100 kg of material, 0.4 to 1.6 gram-molecules, and preferably between 0.6 and 1.25 gram-molecules, of a soluble salt of a metal having several valencies and, after the bath has been acidified with an organic acid until a pH of 3 to 4 has been obtained, it is heated slowly up to a temperature of 60° to 70° C. which is maintained with circulation of the bath for a sufficient time span to obtain uniform fixing of the metal salt on the fibre; the bath is then emptied and the material rinsed with purified water.

The rinsed material thus obtained is treated with a bath of purified water in the presence of an oxidizing agent which does not introduce metal ions and an organic base so as to obtain a pH of 8.5 to 9, and the bath is heated to a temperature of under 50° C., preferably a temperature of about 45° C., whilst the pH is held within the above-mentioned range, the bath being subsequently emptied and the material rinsed with cold purified water.

The rinsed material thus obtained is treated with a bath of purified water containing a reducing agent which does not introduce any metal ions and a sequestering agent, preferably hot at a temperature below 50° C., the bath being subsequently emptied and the material rinsed with cold purified water.

Finally the material thus obtained is treated with a bath of purified water containing an organic acid until a pH of about 3 is obtained, with circulation for a sufficient period of time to achieve uniform distribution of the acid, the material being subsequently drained if necessary and dried.

It is essential to use purified water in each of the process stages in preference to deionized or "bipermutated" water and in any case it must have a hardness which is less than 15 degrees on the French hardness scale.

The keratinous raw material is used in a form that has been pressed dry enough to prevent preferential paths of bath circulation in the mass.

The detergent used is preferably a non-ionic detergent like a condensate of a $C_2$ to $C_4$ alkylene oxide on a molecule of a $C_8$ to $C_{30}$ aliphatic compound, like, for example, a condensate of 5 to 15 moles of ethylene oxide and of a $C_{10}$ to $C_{15}$ aliphatic alcohol, or a similar detergent, in a quantity of about 1 to 2 g/liter of bath.

Ethylenediamine compounds or similar compounds in particular are used as the metal ion sequestering agent, and preferably ethylenediaminetetra-acetic acid or EDTA, in a quantity of about 1 to 2 g/liter of bath.

As alkali phosphate, trisodium phosphate is preferably used in a quantity of about 0.5 to 1 g/liter of bath.

In order to carry out this initial washing stage any other ingredient or any other condition can be used which enables a similar result to be obtained, i.e. a material that has been freed of its natural or foreign impurities and notably of metal salts.

In the mordanting stage cupric salts or ferrous salts or salts of aluminium, titanium or chromium are used as salts of a metal having several valencies and soluble enough in water at the treatment temperature.

According to one embodiment cupric salts are used, notably copper sulphate owing to its high solubility and its low cost. The amount of copper used in the form of cupric salts corresponds to 0.0236–0.095% and preferably 0.035–0.075% by weight of copper referred to the weight of the keratinous fibres.

However, ferrous salts, aluminium salts, titanium salts and chromium salts possessing a high enough solubility under the conditions of the bath used also give good results.

Amongst aluminium salts it is advantageous to use the sulphate, the chloride and the nitrate; amongst ferrous salts the chloride, the nitrate and the sulphate, amongst titanium salts the trichloride and the oxalate, amongst chromium salts the chloride $CrCl_2$, the nitrate, the oxalate and the acetate.

In order to acidify the mordanting bath of pH 3 to 4 an organic acid is used like acetic acid, formic acid, citric acid or a similar acid, acetic acid being preferred.

The temperature is raised slowly to 60° to 70° C. with circulation of the bath so as to obtain a distribution as homogeneous as possible, and the temperature is then maintained still with circulation of the bath, until the metal salt is fixed on the fibre sufficiently, which can be monitored by the change in bath colour or by any other titrating method, notably by potentiometric titration.

As oxidizer it is preferable to use 130-volumes hydrogen peroxide in the necessary amount to obtain a corresponding bath with a content of 2 to 3 and preferably 2.5 volumes of hydrogen peroxide, i.e. 6 to 9 and preferably about 7.6 g of hydrogen peroxide per liter, but it is possible to use any equivalent oxidizer or oxidizing system which does not introduce metal ions into the bath.

As organic base it is preferable to use a $C_2$–$C_4$ alkanolamine, such as mono-, di- or triethanolamine, the latter giving excellent results.

The pH is maintained within the 8.5 to 9 range by adding additional amounts of the organic base. The heating to a temperature of 45° to 50° C., during which oxygen is given off in moderate quantities, is continued during a time period of 1 hour 30 minutes to 2 hours for each total charge of around 1,000 kg, with a bath ratio of around 1:10.

The washing carried out in the presence of a reducing agent and of a sequestering agent is designed to completely free the material of the ingredients used in the preceding treatments. As reducer it is preferable to use an alkali hydrosulphite like sodium hydrosulphite and as sequestering agent EDTA, it being understood that any other reducing agent not introducing metal ions, or any other metal ion sequestering agent, may also be suitable.

The process of the invention is carried out in a vat in a suitable dyeing plant, preferably made of stainless steel, fitted with a good bath circulation system with a facility for reversing the circulation, but avoiding excessively violent circulation and also avoiding excessively powerful pressing of the material.

As keratinous fibre the widest range of animal fibres may be used, notably wool, rabbit hair, camel hair, cashmere, alpaca, etc. fabrics.

The fibres used are undyed fibres which may be either unbleached or naturally coloured. In the latter case the original shade is altered: it generally becomes lighter to a greater or lesser extent. Unbleached clothes are practically unchanged.

The treatment may be carried out on fibres in staple or spun, woven or knitted form. Depending on the material the bath ratios, i.e. the ratio "treated material:-bath" may vary widely from 1:5 to 1:20, but is it preferable to use a bath ratio of 1:8 to 1:15.

The process of the invention makes it possible to obtain a natural fibre for which the felting is considerably reduced, and the feel qualities of which remain virtually unchanged.

The material obtained after the last treatment in the acid bath can be dyed directly or drained, dried and stored.

The following examples in which, unless otherwise specified, the percentages are indicated by weight and the temperatures in degrees Centigrade, will make the object of the invention easier to understand.

EXAMPLE 1

Antifelting treatment of a "first-class fineness" type wool in staple form

Washing

In a stainless steel appliance with pumped circulation and having a working capacity of about 1000 liters, 100 kg of material pressed dry is loaded into the basket of the appliance; it is wetted at a temperature of 20° C. with purified water and the bath is made up to 900 liters of purified water, with 1.2 kg of the reaction product of a $C_{12}$ primary alkanol with 10 molecules of ethylene oxide being added along with 0.9 kg of a 40% solution of ethylenediaminetetra-acetic acid (EDTA) and 0.450 kg of trisodium phosphate. The bath is heated to a temperature of 40° to 45° C. and held at this temperature, with circulation being maintained, for a period of about 30 minutes.

The bath is emptied subsequently and the material copiously rinsed with purified water. This washing operation is repeated several times if necessary until a material is obtained which has had its impurities removed.

A bath is prepared with purified water to which 100 g of copper sulphate (0.626 molecule), previously dissolved in a sufficient amount of hot water, has been added. 900 g of concentrated acetic acid is then added, which enables a pH of about 3–4 to be obtained; the bath is heated, with circulation, up to a temperature of 70° in a period of 15 minutes and the bath is held at this temperature for about 1 hour. The bath is emptied and the material is rinsed with cold purified water.

The bath is prepared with purified water to which 18 liters of 130-volumes hydrogen peroxide is added so as to obtain about 900 liters of bath at about 2.5 volumes. The bath is heated to a temperature of 45° C. in a period of about 15 minutes with circulation, and the bath is held at this temperature for about 2 hours, with the pH being adjusted meanwhile to 8.5 to 9 by adding triethanolamine if necessary. A low and regular emission of oxygen is observed with the bath remaining virtually colourless.

The bath is emptied and the material is copiously rinsed with cold purified water.

End-of-treatment washing

The material is washed with a bath made up of 900 liters of purified water containing 1.8 kg of sodium hydrosulphite and 0.450 kg of ethylenediaminetetra-acetic acid in 40% aqueous solution. The bath is heated to a temperature of 40° C. with circulation and is held at this temperature for 30 minutes. The bath is emptied and the material rinsed copiously with cold purified water.

Final washing

The material thus rinsed is treated with a bath made up of 900 liters of purified water containing 0.9 kg of concentrated acetic acid, and this with circulation of the bath for 15 minutes. The bath is then emptied and the material is drained and dried.

A "first-class fineness" quality wool in staple form is thus obtained which possesses great resistance to felting.

Perfectly analogous results are obtained notably with camel hair or alpaca wool.

EXAMPLE 2

Antifelting treatment of rabbit hair

The treatment is carried out in the same conditions as those indicated in example 1, except that the mordanting is performed with an amount of 1.232 moles of copper sulphate (200 g) per 100 kg of rabbit hair and, in the stage of oxidation in a basic medium, 5.4 kg of triethanolamine are used for 900 liters of bath.

At the end of the treatment rabbit hair is obtained which possesses excellent antifelting properties.

EXAMPLES 3 to 10

Examples 1 and 2 are repeated except that the copper sulphate is replaced by iron chloride (II), aluminium sulphate, titanium trichloride and chromium chloride (II) respectively. These give good results as well.

I claim:

1. A process for the antifelting treatment of keratinous fibres, comprising:

(1) freeing the keratinous fibres of their natural or foreign impurities by hot washing in a bath of purified water containing detergent agents in the presence of at least one metal ion sequestering agent and an alkali phosphate if necessary, emptying the bath and rinsing the keratinous fibres with purified water;

(2) treating the rinsed fibres thus obtained by a bath of purified water containing per 100 kg of material 0.4 to 1.6 moles (gram-molecules) of a water-soluble salt of a metal having several valencies chosen from the cupric salts, the ferrous salts, the aluminum salts and the titanium salts, having a pH of 3 to 4 obtained by addition of an organic acid, heated to a temperature of 60°l to 70° C. with circulation of the bath for a sufficient period of time to achieve homogeneous fixing of the metal salt on the fibre, subsequently emptying the bath and rinsing the fibres with purified water;

(3) treating the rinsed fibres thus obtained with a bath of purified water in the presence of an oxidizing agent which does not introduce metal ions and an organic base to obtain a pH of 8.5 to 9, at a temperature of 45° to 50° C. for a time period of 1 hour 30 minutes to 2 hours, with the pH being maintained within the above-mentioned range by addition of the organic base, subsequently emptying the bath and rinsing the fibres with purified water;

(4) treating the rinsed fibres thus obtained with a bath of purified water containing a reducing agent which does not introduce metal ions and a sequestering agent, until the ingredients used in the treatment have been eliminated, subsequently emptying the bath and rinsing the fibres with purified water; and (5) treating the fibres thus obtained with a bath of purified water having a pH of about 3 obtained by adding an organic acid, the fibres being subsequently either dyed directly or drained and dried.

2. The process according to claim 1, in that a copper salt is used as the water-soluble metal salt.

3. The process according to claim 1, in that copper sulphate is used as the water-soluble salt.

4. The process according to claim 1, in that acetic acid, formic acid or citric acid are used as the organic acid.

5. The process according to claim 1, in that hydrogen peroxide is used as the oxidizing agent.

6. The process according to claim 1, in that a $C_2$ to $C_4$ alkanolamine is used as the organic base.

7. The process according to claim 1, in that the organic base is chosen from monoethanolamine, diethanolamine and triethanolamine.

8. The process according to claim 1, in that an alkali hydrosulphite is used as the reducing agent.

9. The process according to claim 1, in that purified water is used which has a hardness of less than 15 French hardness scale degrees.

10. The process according to claim 1, in that a water-soluble salt chosen from the ferrous salts, the aluminium salts, the titanium salts and the chromium salts is used.

11. The process according to claim 1, further comprising the purified water containing 0.01 to 1.2 moles of a water soluble salt.

12. The process according to claim 1, further comprising treating in step (4) with a hot bath.

* * * * *